US009789938B1

(12) United States Patent
Hargreaves et al.

(10) Patent No.: US 9,789,938 B1
(45) Date of Patent: Oct. 17, 2017

(54) SMALL WATERCRAFT LAUNCHING DEVICE

(71) Applicant: Great Northern Docks, Inc., Naples, ME (US)

(72) Inventors: Paul Richard Hargreaves, Raymond, ME (US); Stephen Joel Merriam, Raymond, ME (US)

(73) Assignee: Great Northern Docs, Inc., Naples, ME (US)

( * ) Notice: Subject to any disclaimer, the term of this patent is extended or adjusted under 35 U.S.C. 154(b) by 0 days.

(21) Appl. No.: 15/470,317

(22) Filed: Mar. 27, 2017

Related U.S. Application Data

(60) Provisional application No. 62/313,923, filed on Mar. 28, 2016.

(51) Int. Cl.

| | |
|---|---|
| ***B63B 35/00*** | (2006.01) |
| ***B63C 1/02*** | (2006.01) |
| ***B63B 1/12*** | (2006.01) |
| ***B63B 27/16*** | (2006.01) |

(52) U.S. Cl.
CPC ..... *B63C 1/02* (2013.01); *B63B 1/121* (2013.01); *B63B 27/16* (2013.01); *B63B 35/00* (2013.01)

(58) Field of Classification Search
CPC ..... B63B 35/00; B63B 27/16; B63B 1/121; B63C 1/02
USPC ..... 114/44, 362
See application file for complete search history.

(56) References Cited

U.S. PATENT DOCUMENTS

| | | | | |
|---|---|---|---|---|
| 5,143,182 | A * | 9/1992 | Basta | B63C 3/06 114/44 |
| 5,664,513 | A * | 9/1997 | Echelbarger | B63C 1/02 114/263 |
| 5,826,528 | A * | 10/1998 | Jancsek | B63C 1/02 114/45 |
| 6,006,687 | A * | 12/1999 | Hillman | B63B 3/08 114/45 |
| 6,823,809 | B2 * | 11/2004 | Hey | B63C 3/02 114/45 |
| 7,182,030 | B2 | 2/2007 | Privette | |
| 7,444,952 | B1 * | 11/2008 | McGann | B63B 59/06 114/222 |
| 7,503,274 | B2 * | 3/2009 | Weed | B63C 1/02 114/45 |
| 8,152,100 | B2 * | 4/2012 | Nicholas | B60P 3/1033 114/261 |
| 8,256,366 | B2 * | 9/2012 | Imel | B63C 3/06 114/263 |
| 8,381,673 | B2 * | 2/2013 | Wirsig | B63B 21/00 114/230.16 |
| 8,388,265 | B2 * | 3/2013 | Basta | B63C 3/06 405/3 |

(Continued)

*Primary Examiner* — Lars A Olson
*Assistant Examiner* — Jovon Hayes
(74) *Attorney, Agent, or Firm* — Jeffrey Joyce

(57) ABSTRACT

A lifting device for lifting and holding a small watercraft in a fixed position and that includes a support structure and a lifting mechanism. The support structure supports the lifting mechanism in a body of water, usually with some form of flotation device. The lifting mechanism is movable between a raised position that holds the watercraft steady and in a fixed position and a lowered position in which the watercraft is floating in the water. A handle bar assembly allows a user to maneuver the lifting mechanism between the positions.

9 Claims, 8 Drawing Sheets

(56) References Cited

U.S. PATENT DOCUMENTS

| | | | | |
|---|---|---|---|---|
| 8,770,130 | B2 | 7/2014 | Holmes | |
| 9,278,735 | B1 * | 3/2016 | Gaiser | B63C 3/06 |
| 2014/0116282 | A1 * | 5/2014 | Horihan | B61B 3/02<br>104/89 |

* cited by examiner

SMALL WATERCRAFT LAUNCHING DEVICE

BACKGROUND INFORMATION

Field of the Invention

The invention relates to devices that are used to launch and dock and otherwise move small watercraft in and out of a body of water.

Discussion of Prior Art

Launching and entering small watercraft, such as kayaks and canoes, is a process that is often fraught with complications as one must hold the craft in a relatively still position in the water as one moves from a position on a solid surface, whether that's on a beach, a float or a dock, into the craft. This balancing act is particularly problematic with kayaks, which sit very low in the water, and overturning such a craft while attempting to enter and launch the craft is a common occurrence. This is true for young and athletic individuals, and is even more problematic for those who are older or who suffer from any number of disabilities and physical limitations.

What is needed, therefore, is a device that will stabilize a small watercraft as a user enters and exits the craft while also assisting the user in launching and docking the craft.

BRIEF SUMMARY OF THE INVENTION

The invention is a small watercraft launching device that supports a watercraft in a fixed and stable position as a user enters or exits the craft and helps to move the watercraft between a fixed position at or near the surface of the water and deployed position in the water. The device includes a support structure that is affixed to a lifting mechanism. The support structure is deployable in a body of water and holds the lifting mechanism at or near the surface of the water. For example, the support structure may have a floating base that allows it to float on the surface of a body of water, or it may have pillars and be fixed in position in a similar manner to a pier, or it may be affixed to another docking station such as another float or dock.

The lifting mechanism includes a support cage that is affixed to the support structure, a craft cradle that supports the watercraft, a plurality of lift guides that pivotably attach the craft cradle to the support structure, and a handle bar assembly for pivotably moving the craft cradle from a docked position to a deployed position.

In most embodiments, the launching device is connected to a dock or pier that connects to a body of land. In these situations, a user carries the watercraft along the dock to the launching device and places the watercraft in the craft cradle, which is in the docked position. In this position, the watercraft is very near or even above the water's surface, and the craft is held by the craft cradle such that there is little to no rocking or sloshing of the watercraft in the water.

The user steps into the watercraft and sits in the proper position for operating the craft, and then pushes the handle bar assembly forward. Pushing the handle bar assembly forward causes the craft cradle to pivot forward and downward, gently dropping the watercraft into the water at which point it may be operated as normal. To exit the watercraft a user paddles or otherwise directs the watercraft into position above the craft cradle, grips the handle bar assembly and pulls the lever in a backward direction, similar to a traditional rowing stroke, causing the cradle to move in an upward direction until it locks in a docked position.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

FIGS. 1-8 illustrate a launching device 100 for small watercraft according to the invention for launching and docking a small watercraft, such as, for example, a kayak K. The launching device 100 includes a lifting mechanism 10 that moves a craft between a raised position and a lowered position and that is affixed to a support structure 50 that supports the lifting mechanism 10 in a body of water. To launch a small watercraft, the user places the craft on top of the lifting mechanism 10 while the mechanism 10 is in a raised position. The lifting mechanism 10 supports the craft at or near the surface of the water in a docked position. The user enters the craft and activates the lifting mechanism 10, lowering the craft into a launched position floating in the water. To use the launching device 100 to lift a small watercraft out of the water, or bring the craft back to a docked position, the user pilots the craft into a position above the lifting mechanism 10 while it is in a lowered position, and activates the mechanism 10 to raise the craft into a supported position at or near the surface of the water.

Figure 1:
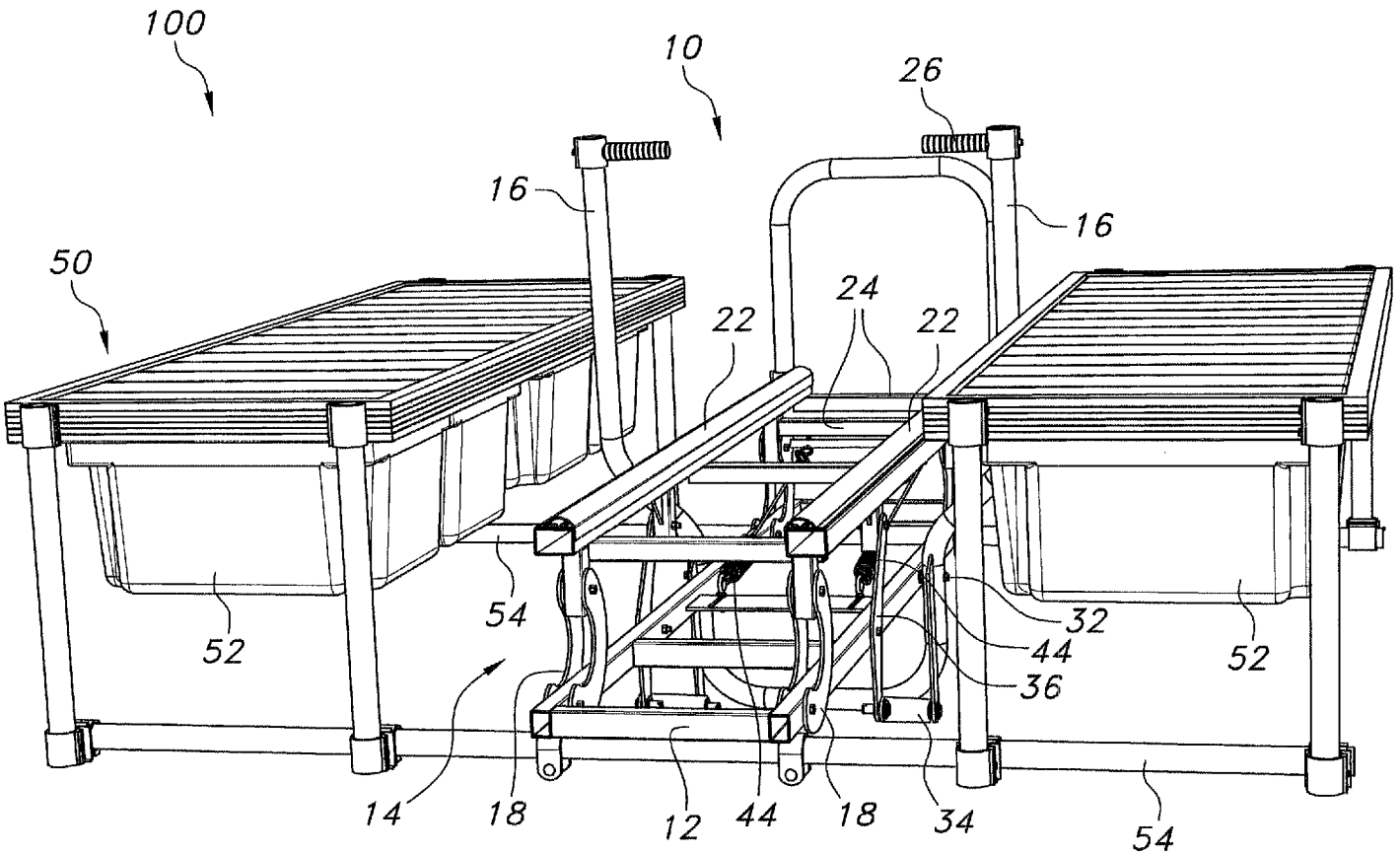
FIG. 1 is a rear perspective view of the launching device according to the invention showing the lifting mechanism in the raised position.
Figure 2:
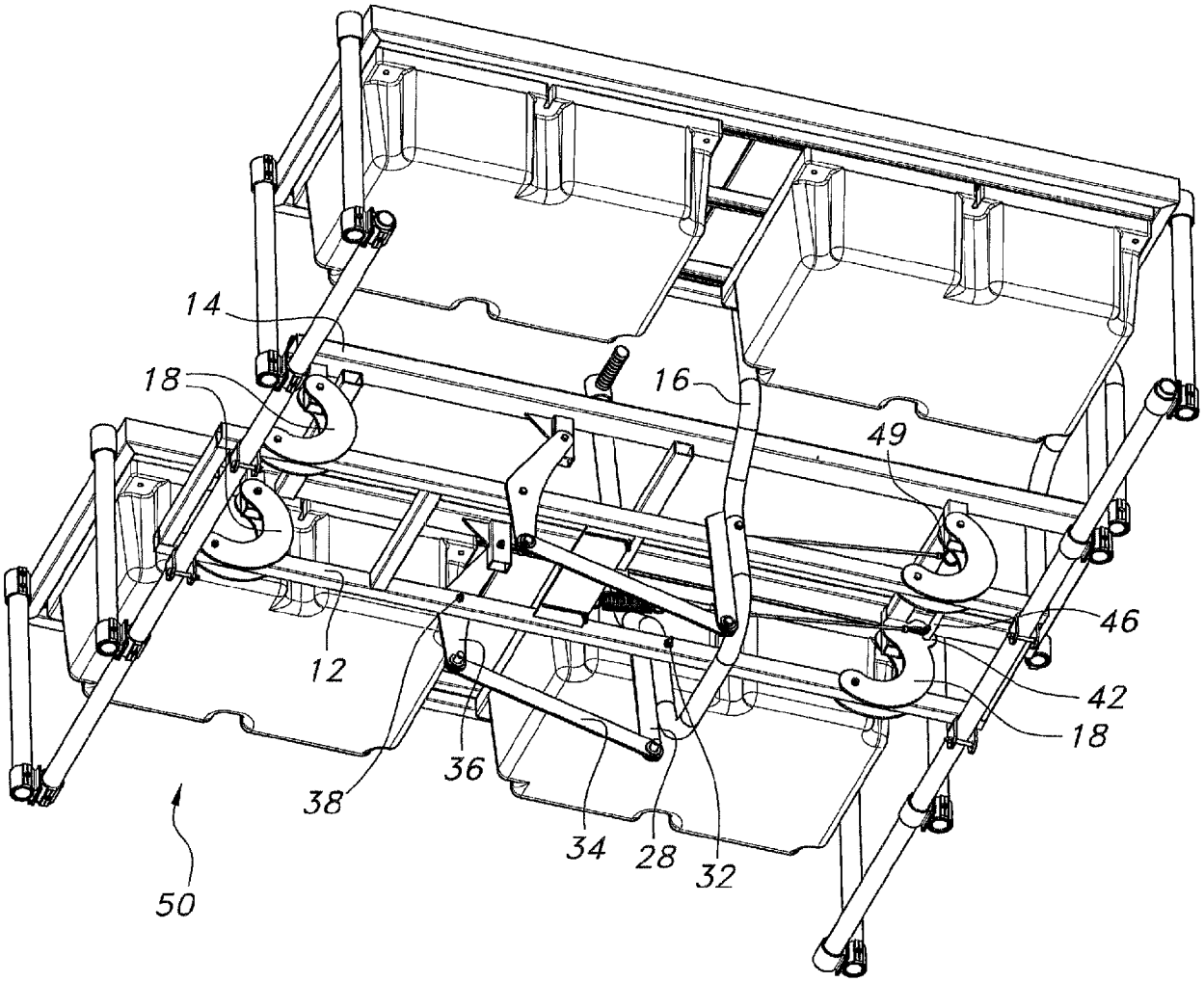
FIG. 2 is a bottom perspective view of the launching device.
Figure 3:
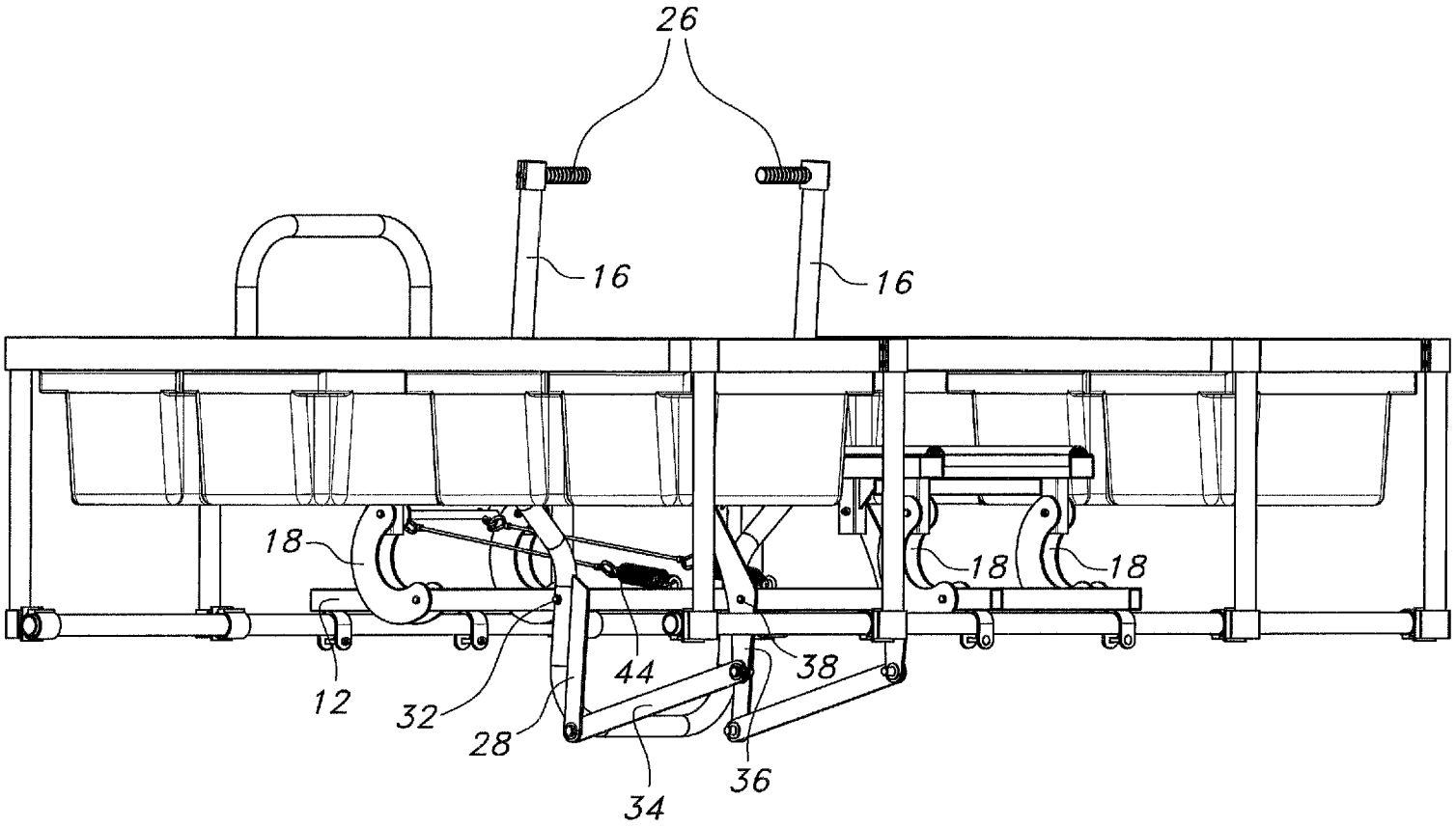
FIG. 3 is a side perspective view of the device.
Figure 5:
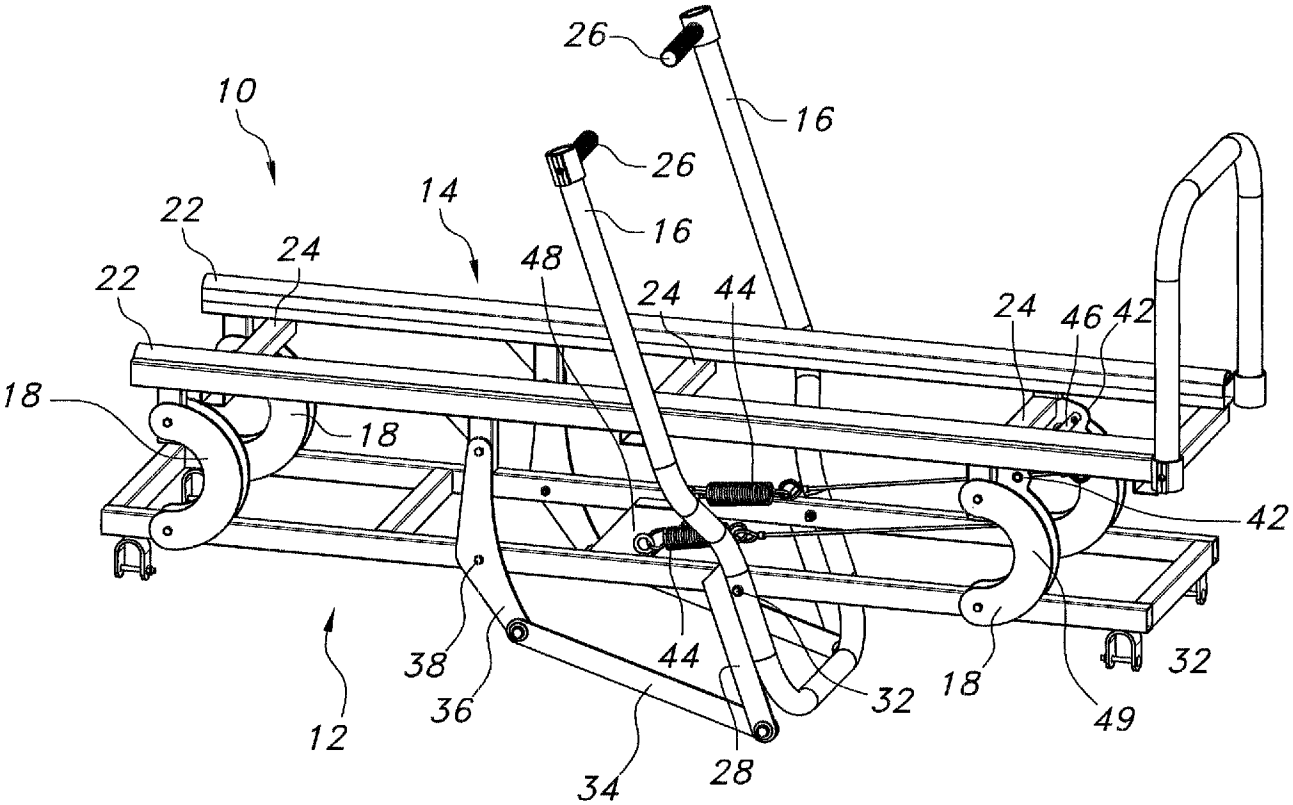
FIG. 5 is a side perspective view of the lifting mechanism in the raised position.
Figure 6:
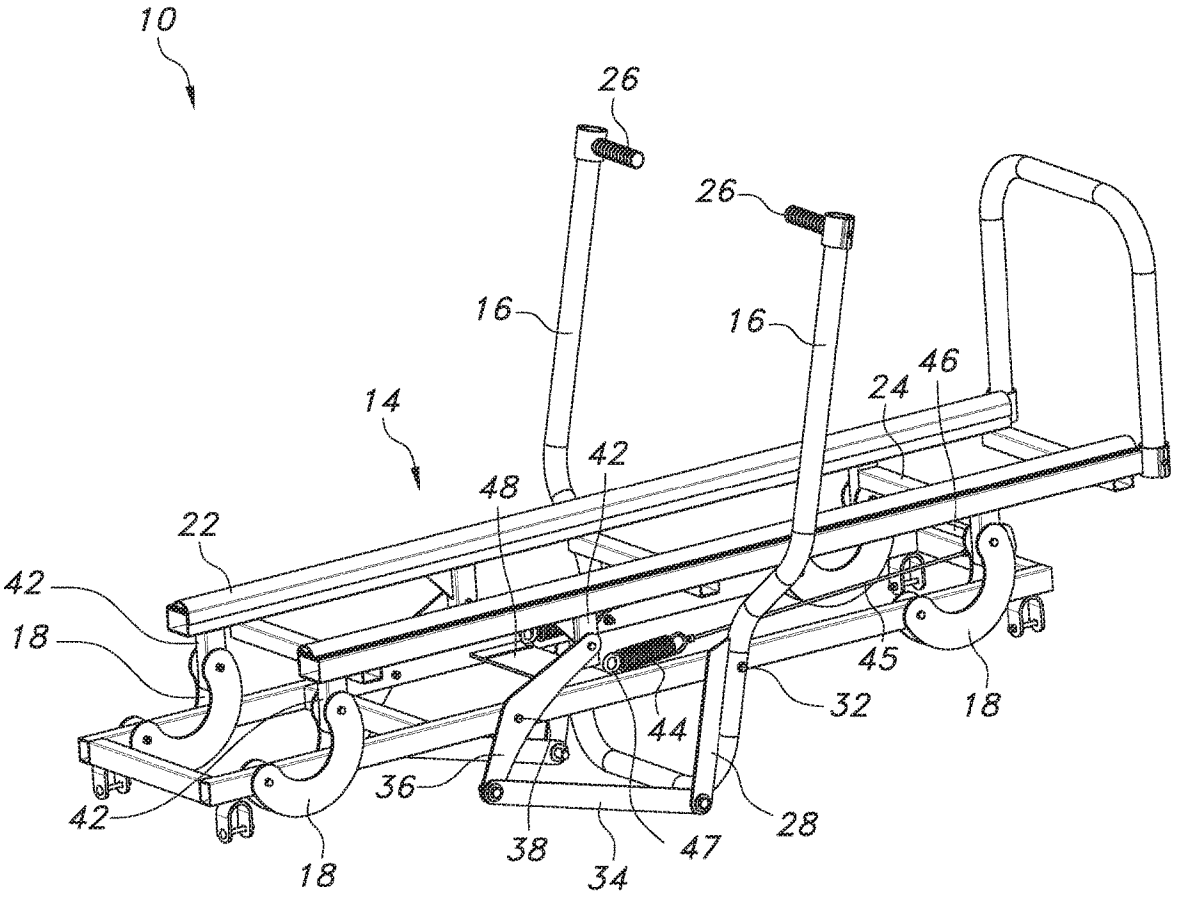
FIG. 6 is a side perspective view of the lifting mechanism in the lowered position.
Figure 7:
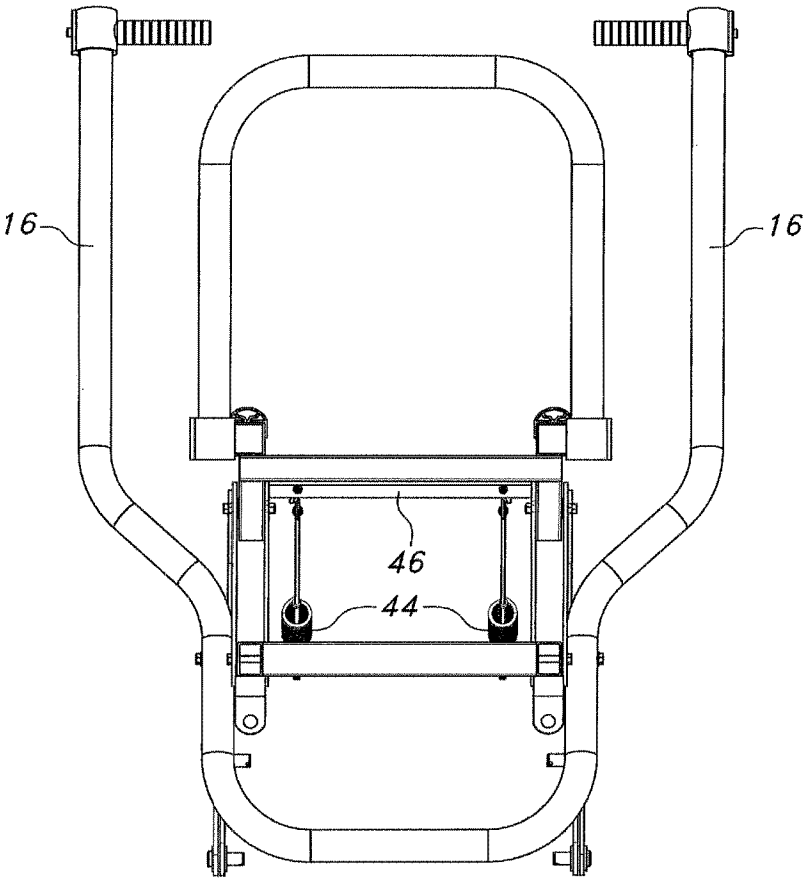
FIG. 7 is a front view of the lifting mechanism.

FIGS. 1, 5 and 6 illustrate the lifting mechanism 10, including a support cage 12, a craft cradle 14, a handle bar assembly 16 and a plurality of lift guides 18. The support cage 12 is affixed to the support structure 50 by any suitable means, for example, through the use of attachable brackets or by being welded together. The craft cradle 14 is pivotably affixed to the support cage 12 and includes two support beams 22 that are connected by crossbars 24. The height of the support beams 22 is sufficient to allow a keel on the small watercraft to fit above the crossbars 24. The crossbars 24 may be curved or angled to allow for a deeper keel.

The embodiment shown includes the handle bar assembly 16 in the form a single u-shaped component that is pivotably affixed to the support cage 12 at pivot point 32 and that includes two handles 26, one handle 26 being positioned on each side of the lifting mechanism 10 and that allow a user to raise and lower the watercraft through a motion that simulates the act of rowing. The handles 26 are positioned such that the average user is located near a midpoint in the cradle 14 when the lifting mechanism 10 is in the elevated position, as shown in FIG. 5. In the raised position, the handle bar assembly 16 is angled back towards the user. To launch the craft from this position, a user simply grips the handles 26 and pushes forward with a single stroke to activate the lifting mechanism 10.

The handle bar assembly 16 is affixed to first lever arms 28 by any suitable means, such as welding. The first lever arms 28 are attached to second lever arms 34 and the second lever arms 34 attach to third lever arms 36. The third lever arms 36 are pivotably attached to the support cage 12 by pivot point 38 and affixed to the craft cradle 14. As the handle bar assembly 16 is pushed forward in the lowered position, shown in FIG. 6, the arms 28, 34, and 36 are moved about the pivot points 32, 38, causing the craft cradle 14 to move forward and downward, lowering the watercraft into a floating position. To raise the watercraft, the user pulls the handle bar assembly 16 backwards to reverse the motion of the arms 28, 34, and 36.

Lift guides 18 are provided at the front and rear of the lifting mechanism 10 to rotatably connect the craft cradle 14 to the support cage 12 and to provide structural support and to guide the craft cradle as it is raised and lowered. As the cradle 14 pivots forward into the launched position stop members 42, illustrated in FIGS. 5 and 6, contact the support cage 12 to prevent the cradle 14 from rotating beyond the desired position.

Figure 4:
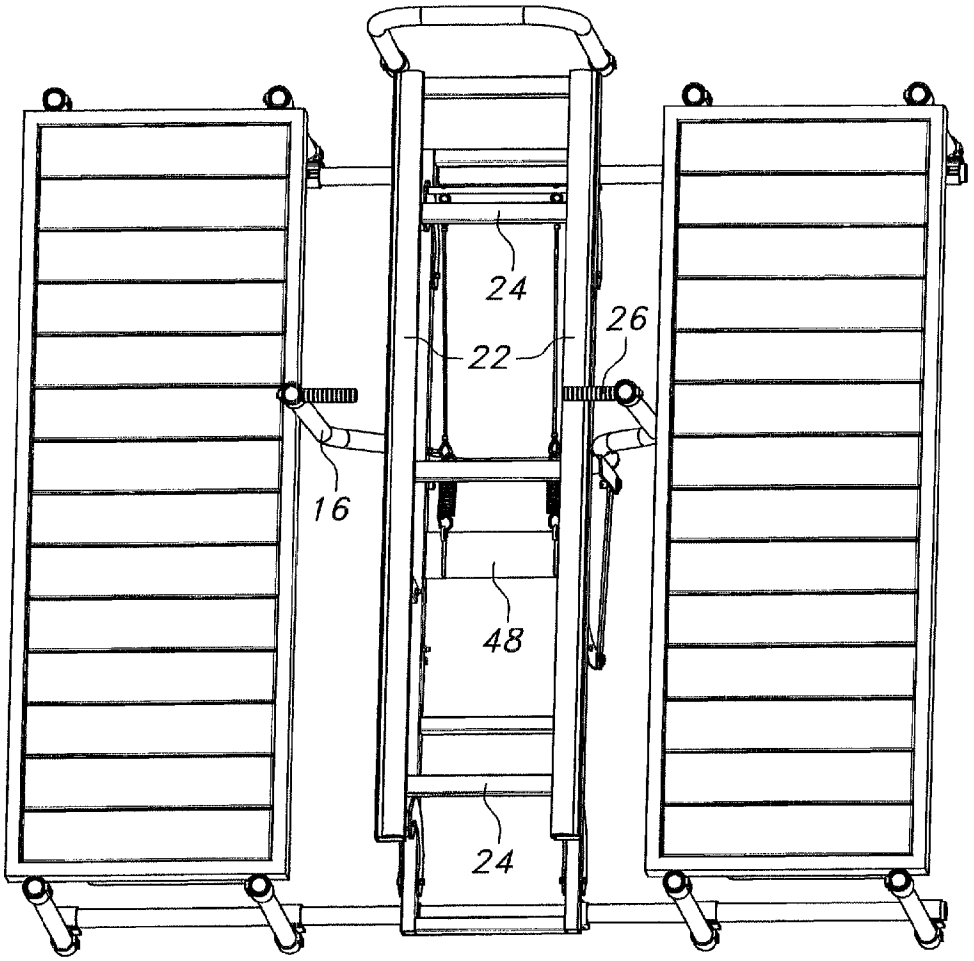
FIG. 4 is a top perspective view of the device.

Springs 44, best shown in FIGS. 4-6, may be provided to attenuate the lowering motion and to assist in the lifting motion, and to secure the craft cradle 14 in either the lowered or elevated position as desired. The springs 44 are affixed on one end to a cross bar 48 that is affixed to the support cage 12 by any suitable connector that allows for a small degree of pivot, such as an I-bolt, and are affixed on an opposite end to a bar 46 that is connected to the front lift guides 18.

The bar 46 is positioned just above a trigger point 49, shown in FIG. 5. As the user pushes the handle bar assembly 26 forward the craft cradle 14 moves forward thereby forcing the lift guides 18 forward. The bar 46 moves forward and at the beginning of the motion the springs 44 exert a force in the opposite direction, effectively pulling the craft cradle 14 upward as the user pushes the craft cradle 14 downward. The lifting guides 18 have a curved shape, and approximately halfway through the forward motion the bar 46 passes the trigger point 49, after which the springs exert a force in the same, i.e. downward, direction. When the craft cradle 14 is in its lowered position the force of the springs 44 secures the craft cradle 14 in the downward and deployed position. Conversely, when the user pulls the handle assembly 26 upward, the bar 46 is pulled above the trigger point and the springs 44 exert a force on the craft cradle 14 in a rear and elevated direction to help the user raise the craft. Once elevated the springs 44 secure the craft cradle 14 in position.

To lower the craft, a user pushes the handle bar assembly 16 forward engaging the springs 44 and requiring the user to exert a small degree of force until the guides 18 reach the trigger point 49. This initially slows the rate at which the craft is lowered into the water. Once the bar 46 passes the trigger point 49 the user may use the handle bar assembly 16 to slow the decent of the craft or, alternatively, let go of the handle bar assembly 16 and allow the craft cradle 14 to be pulled by the springs 44 into the water. Once the bar 46 has passed the trigger point 49 the springs 44 secure the craft cradle 14 in a lowered position. To raise the craft the user pulls the handle bar assembly 16 backward, with a motion similar to a traditional rowing stroke. Initially the springs 44 exert a force in the opposite direction until the bar 46 passes the trigger point, after which the springs 44 exert a force that pulls the craft cradle 14 in the upward direction to assist the user in raising the craft out of the water.

A tension adjuster 47 allows a user to adjust the tension in the springs to modify that amount of effort that must be exerted to raise and lower the craft. For example, in the embodiment shown the tension adjuster 47 is an eye bolt that attaches the spring 44 to the cross bar 48 through a slotted opening that runs parallel to and in line with the spring; tightening the eye bolt in the slot in a position toward the stern-end of the craft increases the tension and thus increases the lifting power of the device 100. In the embodiment shown, the springs 44 connect to cables 45 which connect to the bar 46, however, it is understood that springs of various lengths and sizes may be used and may connect directly to bar 46 or may connect to a cable 45 of varying length.

Figure 8:
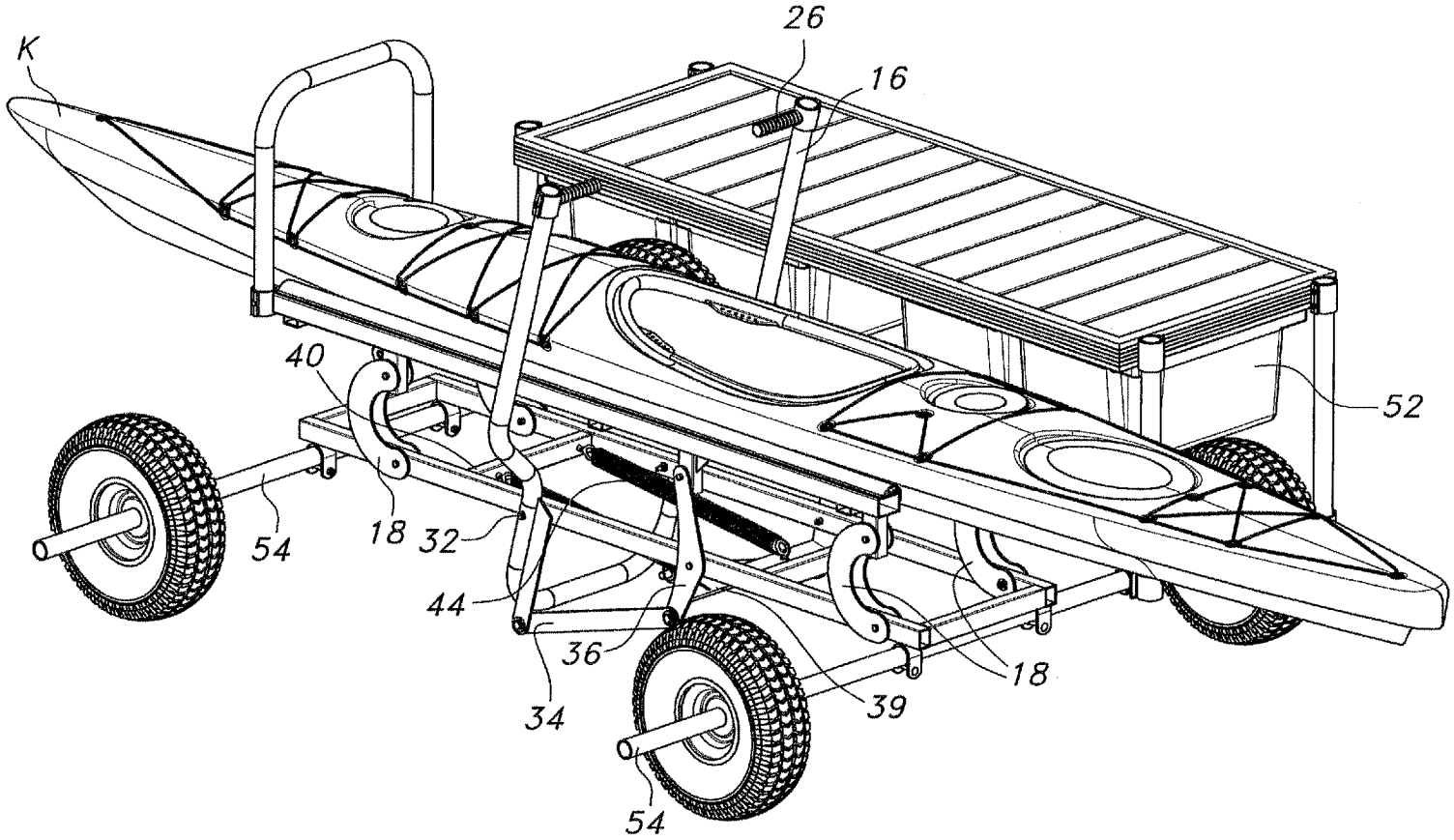
FIG. 8 is a perspective view of the device showing a second embodiment of the springs.

FIG. 8 illustrates a second embodiment of the springs 44. In this embodiment a first spring crossbar 39 is affixed to the support cage 12 and a second spring cross bar 40 is affixed to the third lever arms 36. The springs 44 attach on one end to the first spring cross bar 39 and attach on the other end to the second spring cross bar. The springs 44 are applying constant force in a rear and elevated direction, so that the springs are either helping to pull the craft up into a docking position or slowing the rate at which the craft is lowered into the water. An additional locking mechanism (not shown) is needed to secure the lifting device 100 in a deployed, i.e. lowered, position. There are a number of known ways to provide the locking mechanism, for example, a detent pin may be used along with an additional hole in the lifting device 10.

In the embodiment shown in FIG. 1, the support structure 50 includes two floats 52 that are connected by two cross bars 54, and the support cage 12 is clamped to the crossbars 54. However, it is understood that the structure 50 may be any suitable floating structure or fixed dock that is capable of supporting the lifting mechanism 10 in a body of water, and the support cage 12 may be attached to the support structure 50 using any suitable means, such as, for example, welding.

It is understood that the embodiments described herein are merely illustrative of the present invention. Variations in the construction of the launching device may be contemplated by one skilled in the art without limiting the intended scope of the invention herein disclosed and as defined by the following claims.

What is claimed is:

1. A small watercraft launching device comprising:

a lifting mechanism and a support structure for holding the lifting mechanism in a body of water, the lifting mechanism including a support cage that is affixed to the support structure, a craft cradle for supporting the small watercraft that is pivotably affixed to the support cage, and a handle bar assembly that is affixed to a plurality of lever arms and that is pivotably attached to the support cage; and wherein actuating the handle bar assembly moves the lifting mechanism between raised and lowered positions to launch or dock the small watercraft.

2. The small watercraft launching device of claim 1, further comprising a plurality of lifting guides that pivotably affix the craft cradle to the support cage.

3. The small watercraft launching device of claim 2, wherein the plurality of lever arms include first lever arms, second lever arms and third lever arms, and wherein the first lever arms are pivotably affixed the support cage and to second lever arms, the second lever arms being pivotably affixed to the third lever arms, and the third lever arms being pivotably affixed to the support cage and affixed to the craft cradle.

4. The small watercraft launching device of claim 3, wherein the plurality of lifting guides include front lifting guides and rear lifting guides and wherein stop members are provided to limit the pivotable range of the lifting guides to limit the pivotable range of the craft cradle.

5. The small watercraft launching device of claim 4, further comprising springs that connect the support cage to the front lifting guides, and wherein when the springs are angled above a trigger point they exert a force on the craft cradle in a rear and elevated direction and wherein when the springs are angled below the trigger point they exert a force in the forward and lowered direction.

6. The small watercraft launching device of claim 5, further comprising a tension adjuster that allows a user to adjust the tension in the springs.

7. The small watercraft launching device of claim 6 wherein the craft cradle includes two support beams that are connected by crossbars, the height of the support beams being sufficient to allow a keel on the small watercraft to fit above the crossbars.

8. The small watercraft launching device of claim 7 wherein the support structure includes two floats that are connected by crossbars.

9. The small watercraft launching device of claim 4 further comprising a first spring crossbar that is affixed to the support cage, a second spring crossbar that is affixed to the third lever arms, and springs that connect the first spring crossbar to the second crossbar so as to exert a force on the craft cradle in a rear and elevated direction.

* * * * *